United States Patent [19]

Bonnel

[11] 4,243,180

[45] Jan. 6, 1981

[54] CRUSHING DEVICE

[75] Inventor: Michel G. Bonnel, Comines, France

[73] Assignee: Colmant Cuvelier Dodge, Lille, France

[21] Appl. No.: 896,223

[22] Filed: Apr. 13, 1978

[30] Foreign Application Priority Data

Apr. 14, 1977 [FR] France ..... 77 11198

[51] Int. Cl.[3] ..... B02C 13/14; B02C 13/20

[52] U.S. Cl. ..... 241/79.2; 241/282.1

[58] Field of Search ..... 241/73, 74, 280, 277, 241/282.1, 282.2, 27, 39, 35, 63, 69, 79.2, 79, 83, 84, 86, 86.1, 89.3

[56] References Cited

U.S. PATENT DOCUMENTS

| | | | |
|---|---|---|---|
| 2,344,611 | 3/1944 | Harris | 241/79 |
| 2,770,354 | 11/1956 | Morrison | 241/282.2 X |
| 3,556,420 | 1/1971 | Brown et al. | 241/86 |
| 3,973,735 | 8/1976 | Ito et al. | 241/73 |

FOREIGN PATENT DOCUMENTS

| | | | |
|---|---|---|---|
| 1216080 | 5/1966 | Fed. Rep. of Germany | 241/35 |
| 180744 | 11/1956 | Sweden | 241/74 |

*Primary Examiner*—Mark Rosenbaum
*Assistant Examiner*—Eugene F. Desmond
*Attorney, Agent, or Firm*—Darby & Darby

[57] ABSTRACT

A fine crushing device for mineral or vegetable particles comprising a closed chamber, the bottom of which, of frustoconical shape, is provided with an exhaust opening and inside which is arranged a sifting screen defining with the chamber cover a flat cylindrical volume inside which rotates at high speed at least one rotary knife, whereby the product to be crushed, introduced through a feed opening provided in the cover, is reduced in particles of required fineness through successive impacts against the knife or knives until they pass through the screen.

14 Claims, 4 Drawing Figures

CRUSHING DEVICE

The object of the present invention is a device for crushing very finely vegetable or mineral particles, in order to obtain a powdery product with a granulometry lower than 500 microns, and preferably of the order of 300 microns.

It is known how to crush finely particles of ligneous origin by means of abrasive bands, but the devices of this type, although giving excellent results as to the quality of the end product, are extremely costly as regards the energy consumed. Moreover, they may be the cause of non negligible dangers of fires.

The device according to the present invention is characterized in that it comprizes a closed chamber the bottom of which, preferably of frustoconical shape, is provided with an exhaust aperture in which is located a sifting screen defining with the chamber cover a flat cylindrical volume inside which rotates at high speed at least one rotary knife, so that the product to be crushed, introduced through a feed opening provided in the chamber cover, is reduced in particles displaying the required fineness through successive impacts against the knife or knives until they pass through the screen.

Figure 2:
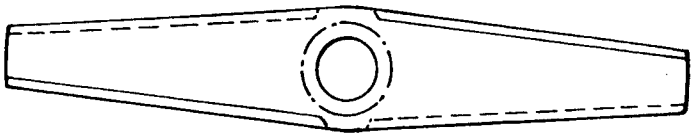
Figure 1:
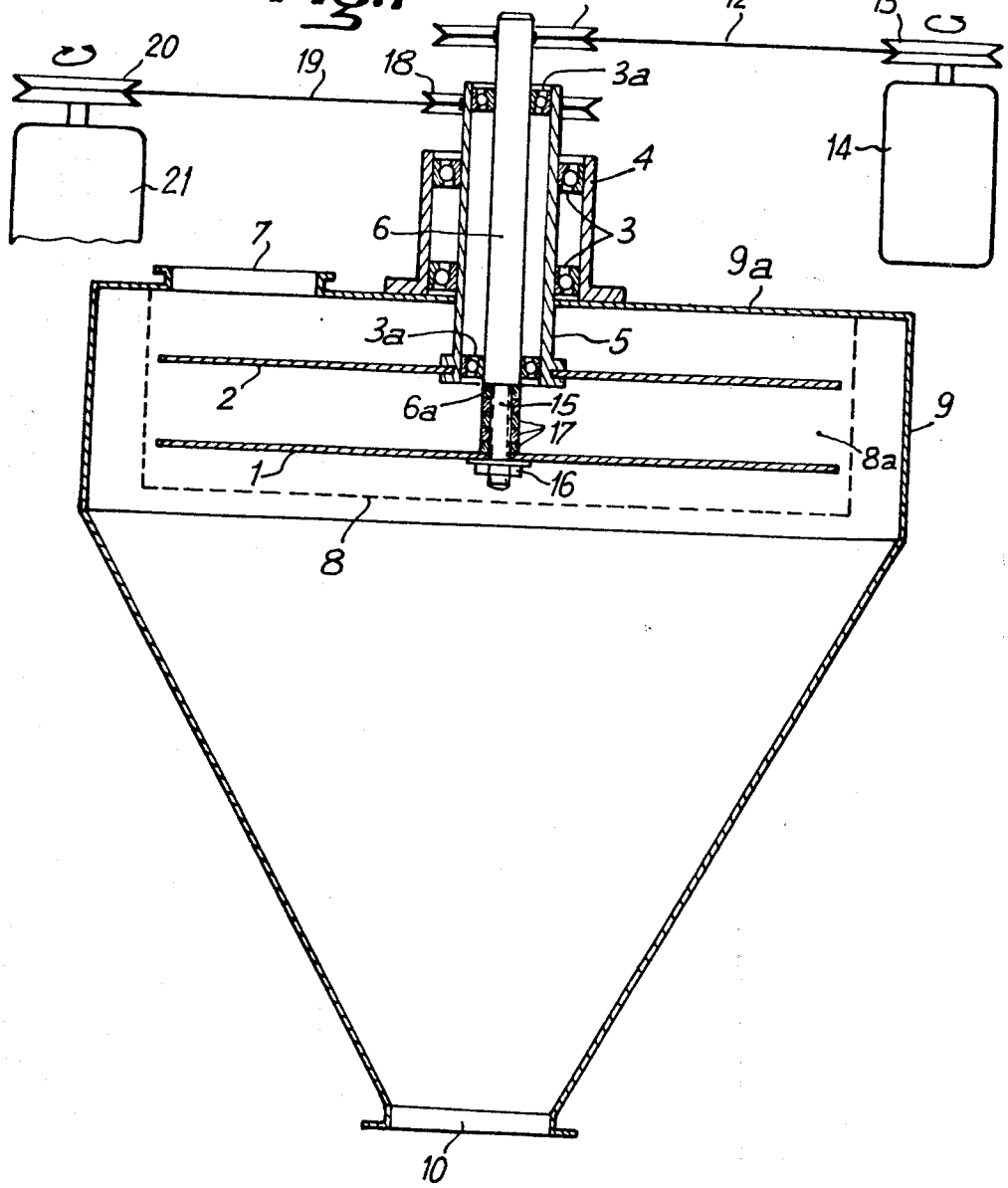
Figure 3:
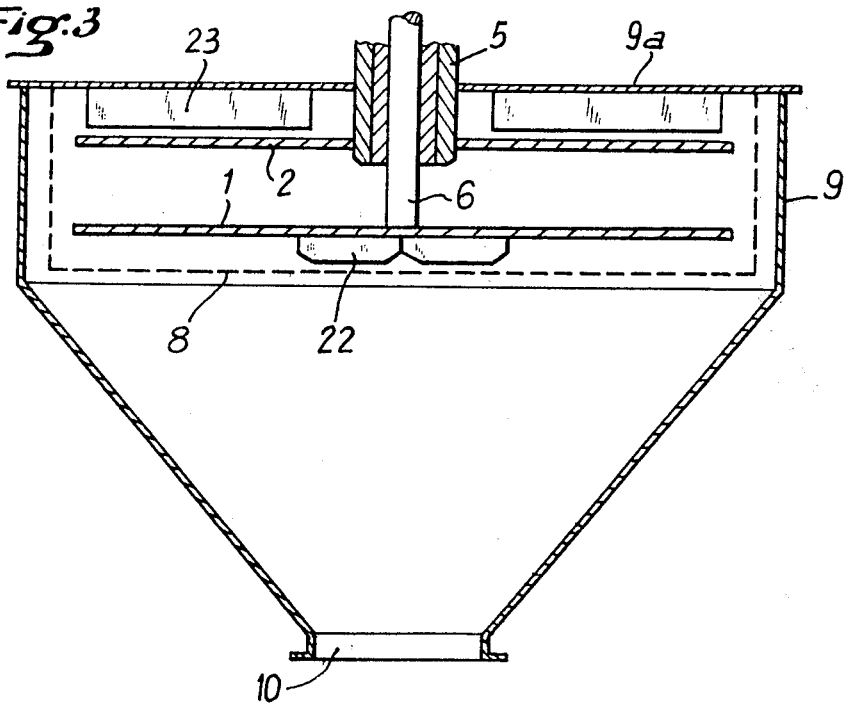
Figure 4:
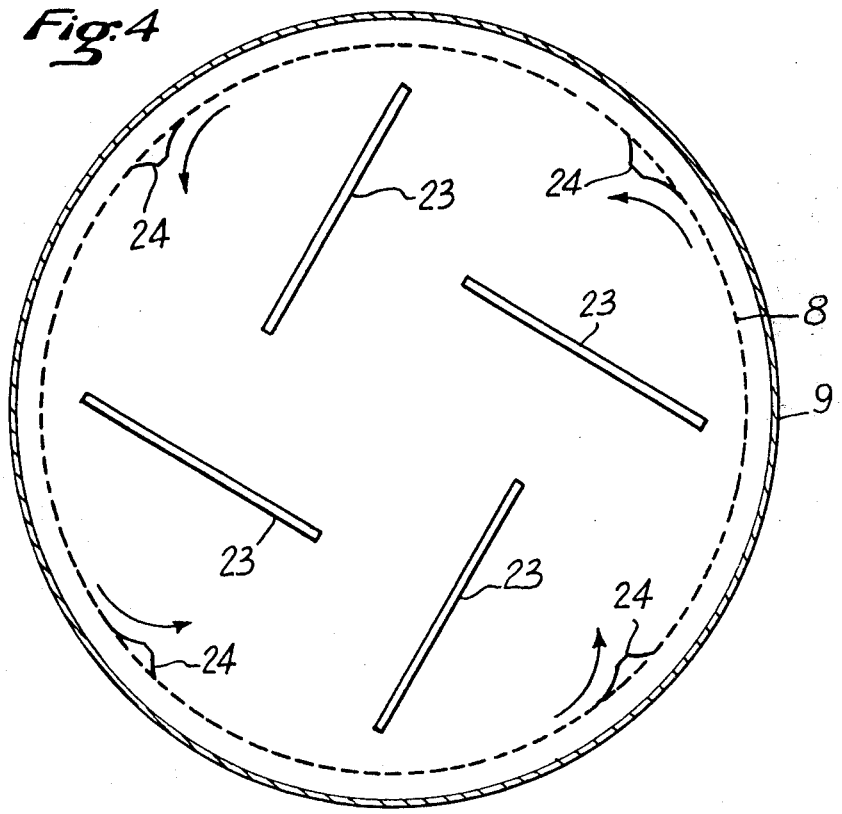

As an example which is not limitative and in order to provide better understanding of the invention, there has been shown in the appended drawings:

In FIG. 1, a cross-sectional side elevation view of one embodiment of the invention, In FIG. 2 a plan view of one of the knives of FIG. 1, In FIG. 3 a side elevation view of an alternative of the device of FIG. 1, In FIG. 4 a partial cross-sectional plan view of FIG. 3.

Referring to these figures, there is shown the device according to the invention comprising a chamber 9 the cover 9*a* of which is flat and circular, the upper portion is cylindrical, the lower portion is frustoconical and provided with an exhaust opening 10.

Inside the cylindrical portion of chamber 9 is arranged a sifting screen defining with the cover 9*a* a cylindrical volume 8*a* the diameter of which is substantially greater than the height.

Inside said cylinder are arranged two knives 1 and 2 of same dimensions and superposed.

The lower knife 1 is carried by a shaft 6 the end of which is provided with a pulley 11 connected via a belt 12 to the pulley 13 of a variable speed motor 14.

Preferably, and as is shown, the end of shaft 6 is formed with a portion 15 of smaller diameter, threaded, so that it is possible by means of a nut 16 to block knife 1 either directly on shoulder 6*a* or at variable distances from said shoulder through the interposition of one or several spacing rings 17.

The upper knife 2 is carried by a hollow shaft 5, co-axial with shaft 6, extending inside shaft 5, the latter being provided with a pulley 18 connected by a belt 19 to the pulley 20 of a variable speed motor 21, whereby the rotation direction of said motor can be reversed.

The hollow shaft 5 is carried on bearings 3 supported by a cylindrical cage 4 and serves in turn as a cage for bearings 3*a* for shaft 6.

The operation of the device thus explained is the following:

The material to be crushed, which may have been advantageously subjected to a previous coarse crushing, is introduced inside volume 8*a* through a feed opening 7 and is reduced into fine particles by the repeated impacts against knives 1 and 2 until they come out through screen 8 and the exhaust opening 10.

For good operation of the device, a certain degree of rotary movement has to be imparted to the material in volume 8*a*, under the action of the knife or knives: under the effect of said rotary movement, the material is centrifuged and caused to pass through the screen 8 when the particle size is sufficiently small; however, the material should not turn too quickly since, if it turns at the same speed as knife 1, there will be no more impacts and thereby no crushing effect.

For obtaining such a rotary movement, one has to adjust the rotation speed of the knives, their rotation direction and their spacing as a function of the nature and density of the product.

Generally, the higher the density of the product introduced through opening 7, the smaller the spacing between the two knives 1 and 2, whereby said spacing can be, at the limit, zero and in such a case the device comprises a single knife only. Conversely, the lower the density of the product, the larger the spacing, the limit being approximately in the region of 50 millimeters.

Likewise, when very light products such as wool combing waste are being crushed, said products are easily driven by the knives. It is then advantageous to have the knives rotating in reverse directions.

Moreover, it proves that for the majority of the products, a quicker flow and therefore a higher efficiency is obtained by rotating the two knives in reverse directions.

In the example shown, the device comprises two knives, but as has been explained, there may be only one; it is also possible to have more than two, the spacings, the rotational speeds (between 300 and 6000 turns per minute) and the rotation directions being determined as a function of the nature of the product.

For obtaining a maximum throughput, it is important that the feed through opening 7 be regular so that the load on knives 1 and 2 is constant: in this connection, the quantity determination is advantageously provided by means of an endless screw (not shown). The rotational speed of said endless screw may be under the control of the intensity absorbed by motors 14 and 21 through an amperemetric relay.

Preferably, and as is shown, the axis of the knives extends vertically but it may be set horizontally or obliquely.

With the device constructed in this way, it is possible to obtain a powdery product for a far lesser cost than with the existing machines; thus, as an example, by feeding the machine with wood chips, 1000 kilograms of powdery product have been obtained, with particle size comprized between 250 and 300 microns, by consuming 23 kilowatts, whereas for obtaining the same result with a known type hammer crushing mill, 210 kilowatts were used.

The end product may be used in any desired manner; however it is more particularly intended for being fed to burners of fuel in powder form. It is also possible to burn in such burners waste of various natures and origins: such as wood scraps, saw dust, chips, textile waste such as wool combing waste and linen waste, or also agricultural refuse such as straws or vine shoots.

FIGS. 3 and 4 relate to an alternative embodiment of the device described in FIG. 1 and 2, developed for providing a better stirring and a better re-cycling of the product inside a crushing mill.

Referring to FIGS. 3 and 4, in order to avoid piling of material underneath and in the center of knife 1, two centrifuging blades 22 have been arranged on the lower face of the latter for rejecting the material to the periphery of chamber 8.

On the other hand, above cover 9*a* are arranged recycling deflectors 23 which, on the contrary, return the material towards the center.

Through the double effect of the centrifuging blades 22 and of vanes 23, there is obtained an improvement of the circulation of the material through the crushing device and thereby an operational improvement of the latter.

As is shown in FIG. 4, it is possible to improve the action of vanes 23 by forming the inner wall of chamber 8 with one or several bossings 24.

With the device described hereabove with reference to FIGS. 1 to 4, it is possible to set in a powdery state vegetable as well as mineral materials, meaning that it is possible to reduce into powder form various refuses from wood, straw, coals and peat. But without departing from the scope of the invention, it is also possible to use the crushing device to obtain in a powdery state paper or cardboard mill waste and even products such as the residues of the distillation of wool washing slimes.

What is claimed is:

1. A device for crushing particles into a finer size comprising:

means forming a generally vertically disposed chamber, said chamber having an inlet into which the particles to be crushed are loaded and an outlet, screening means disposed generally horizontally within said chamber between said inlet and outlet and defining a space between said screening means and said inlet, the porosity of said screening means selectively allowing passage therethrough of crushed particles of different sizes, a plurality of knives disposed generally horizontally and stacked one above the other within said defined space and above said screening means for crushing said particles, means for rotating at least one of said knives but less than said plurality of knives at a first rotational speed, and means for rotating at least one of the remaining said knives at a second rotational speed to create relative movement between said at least one knife and said at least one remaining knife the particles within said defined space being subjected to repeated impacts against the knives until reduced to the fineness required to pass through the screening means to the outlet of the device.

2. A device according to claim 1, wherein the plurality of knives comprises substantially identical knives.

3. A device according to claim 1, wherein each of said plurality of knives rotates in the same direction.

4. A device according to claim 1, wherein said first rotational speed is different from said second rotational speed.

5. A device according to claim 1, wherein the individual knives of said plurality of knives are arranged in stacked relationship with each other, and the spacing between the adjacent knives of said stacked knives is adjustable.

6. A device according to claim 1, wherein said at least one knife rotates in a direction counter to the direction of rotation of said at least one remaining knife.

7. A device according to claim 6, wherein said first rotational speed is substantially equal to said second rotational speed.

8. A device according to claim 1 further comprising means for feeding particles to the space defined by said screening means.

9. A device according to claim 1 wherein the lower portion of said chamber has a frustroconical shape.

10. A device according to claim 1 wherein said screening means comprises a sifting screen for defining a cylindrical space within said chamber.

11. A device according to claim 1 wherein one of said rotating means comprises a rotatable hollow shaft and the other said rotating means comprises a rotatable shaft coaxial with said hollow shaft and disposed within the interior of said hollow shaft.

12. The device according to claim 1 wherein the first and second rotational speeds are in the range of approximately 300 to approximately 6,000 revolutions per minute.

13. A device for crushing particles comprising:

means forming a chamber, screening means within said chamber defining a space between said screening means and a wall of said chamber, the porosity of said screening member means selectively allowing passage therethrough of crushed particles of different sizes, a plurality of knives disposed within said defined space for crushing said particles, means for rotating at least one of said knives but less than said plurality of knives at a first rotational speed, and means for rotating at least one of the remaining said knives at a second rotational speed to create relative movement between said at least one knife and said at least one remaining knife wherein the individual knives of said plurality of knives are arranged in stacked relationship to each other and the outermost knife of said stacked knives is provided on its outer face with at least one centrifuging blade for moving said particles to the periphery of said space between said screening means and a wall of said chamber, further comprising at least one re-cycling blade disposed within said space for returning said particles towards the center of said space.

14. A device according to claim 13, further comprising deflecting means within said defined space for returning said particles towards the center of said space.

* * * * *